US009875682B2

(12) United States Patent
Shi et al.

(10) Patent No.: US 9,875,682 B2
(45) Date of Patent: Jan. 23, 2018

(54) DISPLAY METHOD AND DISPLAY PANEL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lingyun Shi, Beijing (CN); Rui Liu, Beijing (CN); Xiaobo Xie, Beijing (CN); Quanhua He, Beijing (CN); Kai Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 394 days.

(21) Appl. No.: 14/437,025

(22) PCT Filed: Sep. 30, 2014

(86) PCT No.: PCT/CN2014/087880
§ 371 (c)(1),
(2) Date: Apr. 20, 2015

(87) PCT Pub. No.: WO2015/143860
PCT Pub. Date: Oct. 1, 2015

(65) Prior Publication Data

US 2016/0247440 A1 Aug. 25, 2016

(30) Foreign Application Priority Data

Mar. 25, 2014 (CN) ..... 2014 1 0114137

(51) Int. Cl.
*G09G 3/20* (2006.01)
*G09G 3/36* (2006.01)
*G09G 3/3208* (2016.01)

(52) U.S. Cl.
CPC ..... *G09G 3/2074* (2013.01); *G09G 3/3208* (2013.01); *G09G 3/36* (2013.01);
(Continued)

(58) Field of Classification Search
CPC ..... G09G 3/2074; G09G 3/3208; G09G 3/36; G09G 2300/0465; G09G 2300/0452;
(Continued)

(56) References Cited

U.S. PATENT DOCUMENTS

2008/0030527 A1* 2/2008 Namie ..... G06T 3/4023 345/698
2009/0128467 A1* 5/2009 Chen ..... G09G 3/3607 345/87

(Continued)

FOREIGN PATENT DOCUMENTS

CN 1499477 A 5/2004
CN 1571990 A 1/2005

(Continued)

OTHER PUBLICATIONS

Chinese Patent Application No. 201410114137.X, Office Action dated Nov. 25, 2015, six (6) pages, English translation, five (5) pages.

(Continued)

*Primary Examiner* — William Boddie
*Assistant Examiner* — Saifeldin Elnafia
(74) *Attorney, Agent, or Firm* — Nath, Goldberg & Meyer; Joshua B. Goldberg

(57) ABSTRACT

The present invention provides a display method and a display panel. The display panel comprises a plurality of
(Continued)

rows of sub-pixels, the adjacent sub-pixels in the column direction having different colors and being staggered from each other by a half of a sub-pixel. The display method comprises: generating an original image composed of a matrix of virtual pixels; enabling the virtual pixels to correspond to sampling locations, wherein one sampling location is included between any two adjacent sampling locations corresponding to the virtual pixels in each distribution section, three sampling locations are included between two adjacent distribution sections; among the sampling locations in any two adjacent rows, the sampling locations corresponding to the virtual pixels are not arranged in the same columns

12 Claims, 2 Drawing Sheets

(52) U.S. Cl.
CPC ..... *G09G 2300/0452* (2013.01); *G09G 2300/0465* (2013.01)

(58) Field of Classification Search
CPC ..... G09G 2340/10; G09G 2340/04; G09G 2340/0428; G09G 2340/0464; G09G 2340/0471; G09G 2340/0478; G09G 2340/0485; G09G 2340/0421; G09G 5/02; G09G 2320/0666; G06T 3/4069; G06T 3/4007; G06T 3/40; H01L 27/3218
See application file for complete search history.

(56) References Cited

U.S. PATENT DOCUMENTS

| | | | | |
|---|---|---|---|---|
| 2011/0140999 | A1* | 6/2011 | Beland ..... | G06F 3/1446 345/82 |
| 2012/0293531 | A1 | 11/2012 | Wang et al. | |

FOREIGN PATENT DOCUMENTS

| | | | |
|---|---|---|---|
| CN | 1737650 | A | 2/2006 |
| CN | 1871634 | A | 11/2006 |
| CN | 101123061 | A | 2/2008 |
| CN | 101123079 | A | 2/2008 |
| CN | 102622981 | A | 8/2012 |
| CN | 102779495 | A | 11/2012 |
| CN | 103093722 | A | 5/2013 |
| CN | 103151018 | A | 6/2013 |
| CN | 103366683 | A | 10/2013 |
| CN | 103903549 | A | 7/2014 |
| EP | 0 899 604 | A2 | 3/1999 |
| EP | 2333760 | A2 | 6/2011 |
| JP | 2006058604 | A | 3/2006 |
| JP | 2007324667 | A | 12/2007 |

OTHER PUBLICATIONS

Search report issued in International Application No. PCT/CN2014/087880 dated Dec. 23, 2014 (Dec. 23, 2014).

* cited by examiner

Display image according to the prior art method

Display image according to the method of the embodiment of the present invention

DISPLAY METHOD AND DISPLAY PANEL

This is a National Phase Application filed under 35 U.S.C. 371 as a national stage of PCT/CN2014/087880, filed Sep. 30, 2014, and claims priority benefit from Chinese Application No. 201410114137.X, filed Mar. 25, 2014, the content of each of which is hereby incorporated by reference in its entirety.

FIELD OF THE INVENTION

The present invention relates to the field of display technology, and particularly to a display method and a display panel.

BACKGROUND OF THE INVENTION

As illustrated in FIG. 1, a traditional display panel includes a plurality of 'pixels 1' arranged in a matrix, in which each pixel 1 is composed of three adjacent red, green and blue sub-pixels 9 which are arranged in a row. Each sub-pixel 9 can independently emit light of certain luminance (of course the light has specific color), and by light mixing effect the three sub-pixels 9 together constitute an independent display 'point' on a screen.

With the development of technology, the resolution of a display panel becomes increasingly higher, which requires reducing the dimension of the pixel (or the sub-pixel) in the display panel. However, due to limitation of processes, the dimension of the sub-pixel cannot be infinitely reduced, which becomes a bottleneck restricting further improvement in resolution. In order to solve the problem mentioned above, a virtual algorithm technology may be employed to improve the resolution 'sensed' by the user by 'sharing' the sub-pixels; that is to say, one sub-pixel can be used for displaying contents in a plurality of pixels, thereby enabling the visual resolution to be higher than the actual physical resolution.

However, the effect of the existing virtual algorithm technologies is not good enough, some will cause defects such as image distortion, jagged lines, grid spots and the like and some will require calculations such as picture partitioning, picture layering and area ratio, resulting in complex process and large calculation amount.

SUMMARY OF THE INVENTION

In view of the problem that the effect of the existing high resolution display technology is not good enough, the object of the present invention is to provide a display method and a display panel, which can realize high resolution display and provide good display effect.

A technical solution employed to solve the technical problem of the present invention is a display method applied to a display panel, wherein the display panel includes a plurality of rows of sub-pixels, the sub-pixels in each row are formed by cyclically arranging sub-pixels of three colors, the cyclical orders of the sub-pixels in the respective rows are the same, and the adjacent sub-pixels in the column direction have different colors and are staggered from each other by ½ of the sub-pixel in the row direction. The display method comprises the following steps:

S1, generating an original image composed of a matrix of virtual pixels;

S2, enabling the virtual pixels to correspond to sampling locations, wherein among the sampling locations in each row, the sampling locations corresponding to the virtual pixels are distributed in a plurality of distribution sections, wherein one sampling location is included between any two adjacent sampling locations corresponding to the virtual pixels in each distribution section, three sampling locations are included between two adjacent distribution sections; among the sampling locations in any two adjacent rows, the sampling locations corresponding to the virtual pixels are not arranged in the same column, wherein each sampling location corresponds to a location between two adjacent sub-pixels in one row and a central location of a sub-pixel in the other row; and S3, calculating a display component of each sub-pixel in accordance with original components of corresponding colors of the virtual pixels corresponding to the sub-pixel.

The terms 'row' and the 'column' used herein refer to two directions perpendicular to each other in the matrix of virtual pixels (or sub-pixels), which are irrelevant to the shape of the sub-pixels, placement of the display panel, layout of leads and the like.

Preferably, the display panel is a liquid crystal display panel or an organic light-emitting diode (OLED) display panel.

Preferably, the sub-pixels of three colors include a red sub-pixel, a blue sub-pixel and a green sub-pixel.

Preferably, in any two adjacent rows of sampling locations, in one row, each distribution section has two sampling locations corresponding to the virtual pixels; and in the other row, two distribution sections at two ends of the other row have one and three sampling locations corresponding to the virtual pixels respectively, while each of the other distribution sections has two sampling locations corresponding to the virtual pixels.

Preferably, the dimension of a sub-pixel in the first or the last row in the column direction is ½ of that of a standard sub-pixel in the column direction.

Preferably, except the first row and last row of sub-pixels, one sub-pixel of two sub-pixels at the ends of the other rows of sub-pixels corresponds to one virtual pixel, and the dimension of the one sub-pixel in the row direction is ½ of that of a standard sub-pixel in the row direction.

Preferably, the step S3 includes: obtaining a display component of each sub-pixel by multiplying the original components of the corresponding colors of the virtual pixels corresponding to the sub-pixel by respective proportional coefficients and then summarizing the respective products.

Further preferably, the sum of the proportional coefficients for the original components of the corresponding colors of the respective virtual pixels corresponding to each sub-pixel is 1.

Further preferably, the proportional coefficient for the original component of the corresponding color of the virtual pixel corresponding to any standard sub-pixel ranges from 0.5 to 0.9.

Preferably, both the original component and the display component are luminance, and the method further includes a step S4 after the step S3: calculating the gray scale of each sub-pixel in accordance with the display component of the sub-pixel.

The present invention further provides a display panel, comprising a plurality of rows of sub-pixels, in which the sub-pixels in each row are formed by cyclically arranging sub-pixels of three colors, and the cyclical orders of the sub-pixels in the respective rows are the same, the adjacent sub-pixels in the column direction have different colors and are staggered from each other by ½ of the sub-pixel in the row direction.

In the display method of the present invention, the content displayed by each sub-pixel (i.e. standard sub-pixel, except several sub-pixels in the edge regions) is substantially determined by two virtual pixels adjacent to this sub-pixel. That is, one sub-pixel is 'shared' by two virtual pixels; or rather, each sub-pixel is used for representing the contents of the two virtual pixels at the same time, thereby enabling the visual resolution to be twice of the actual physical resolution in combination with a specific display panel and achieving a better display effect. At the same time, the content displayed by each sub-pixel is directly obtained by calculation based on a plurality of specific virtual pixels without complex calculations such as 'partitioning, layering and area ratio'. Therefore, the display method requires simple process and small calculation amount.

The present invention is especially suitable for high resolution display.

REFERENCE NUMERALS

1: Pixel
2: Virtual pixel
8: Sampling location
9: Sub-pixel

DETAILED DESCRIPTION OF THE EMBODIMENTS

The present invention will be further described below in conjunction with the accompanying drawings and embodiments, in order to make a person skilled in the art better understand the technical solution of the present invention

Embodiment 1

Figure 1:
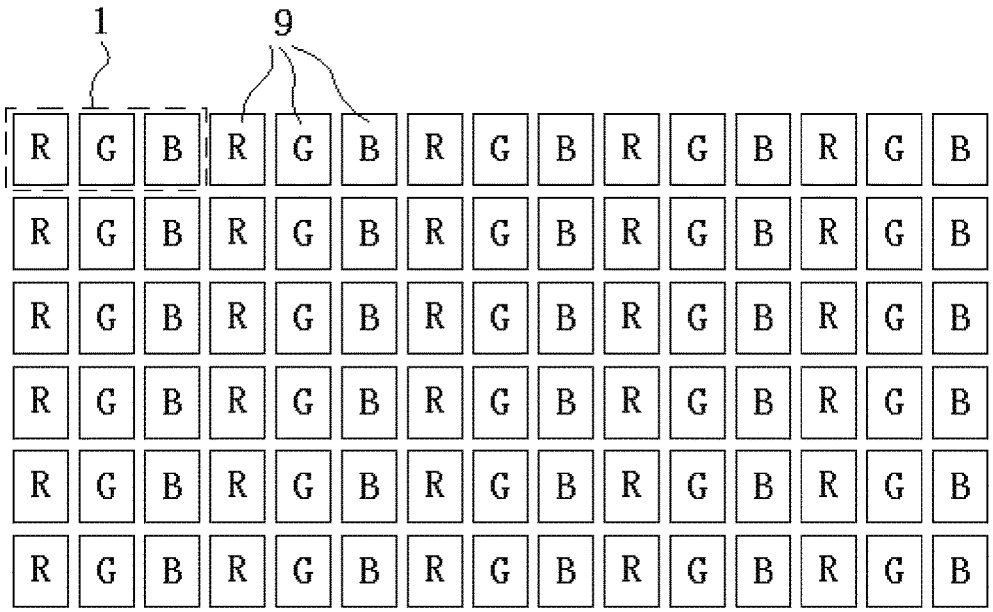
Fig. 1 (Prior Art)
FIG. 1 is a structural diagram of an existing display panel.
Figure 2:
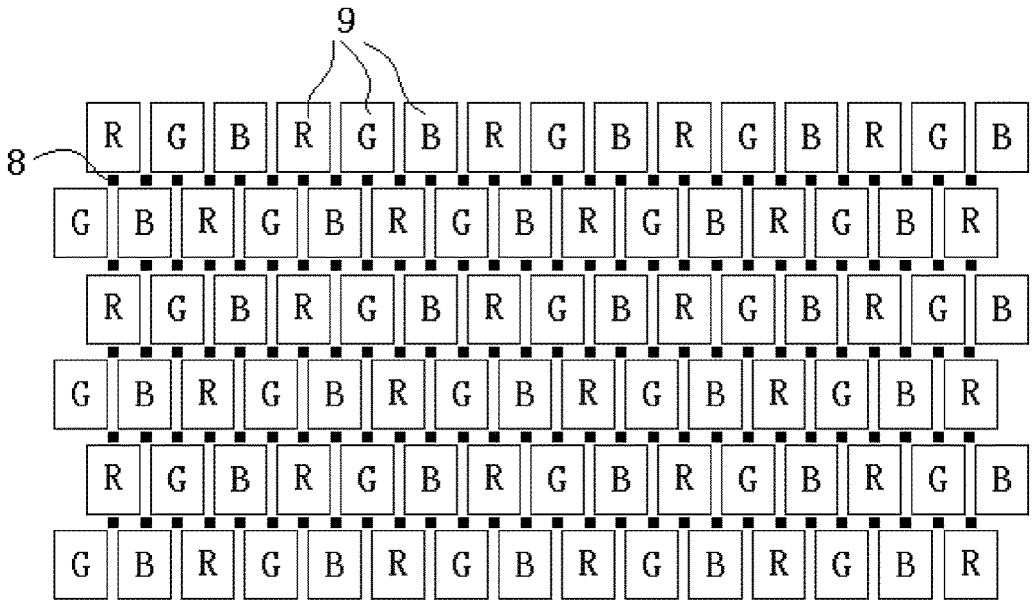
FIG. 2 is a structural diagram of a display panel using a display method of embodiment 1 of the present invention.
Figure 3:
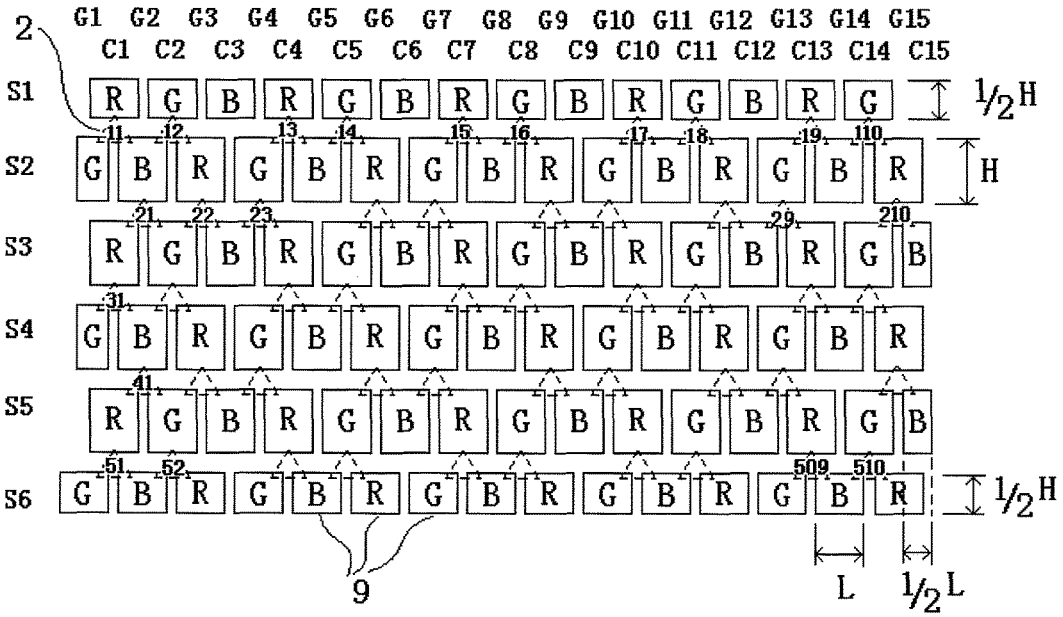
FIG. 3 is a schematic diagram illustrating locations corresponding to virtual pixels in the display method of embodiment 1 of the present invention.
Figure 4:
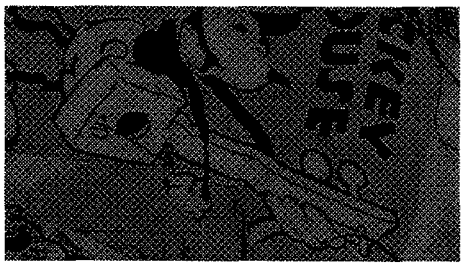
FIG. 4 is a comparison diagram illustrating display effects of the existing method and the method of embodiment 1 of the present invention.
Figure 4:
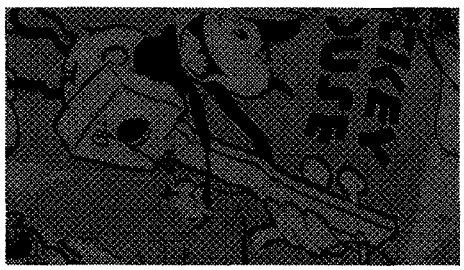

As illustrated in FIG. 2 to FIG. 4, the embodiment provides a display method, which is suitable for a display panel of the embodiment.

The display panel of the embodiment includes a plurality of rows of sub-pixels 9, in which the sub-pixels 9 in each row are formed by cyclically arranging sub-pixels 9 of three colors in turn, and cyclical orders of the sub-pixels 9 in the respective rows are the same. Preferably, the sub-pixels 9 of three colors are red sub-pixels 9, blue sub-pixels 9 and green sub-pixels 9, respectively, and the embodiment will be described by taking this mode as an example, i.e. the display panel of the embodiment is in an RGB mode. Of course, the display methods of the present invention are also applicable to the display panels having other arrangement modes, such as arrangement including other colors or arrangement in which the number of the sub-pixels in each pixel is 2, 4 or other number.

That is, as illustrated in FIG. 2, the sub-pixels 9 of three different colors in each row form a cyclical unit (for example, a cyclical unit of 'red sub-pixel 9 to green sub-pixel 9 to blue sub-pixel 9'), and a plurality of cyclical units constitute a row of the sub-pixels 9; in different rows, starting sub-pixels 9 have different colors, but the cyclical arrangement orders of the sub-pixels 9 are the same. For example, in FIG. 2, the first sub-pixel in the first row is a red sub-pixel 9, and the sub-pixels in the first row are cyclically arranged according to an order of 'red sub-pixel 9 to green sub-pixel 9 to blue sub-pixel 9 to red sub-pixel 9'; the first sub-pixel in the second row is a green sub-pixel 9, and the sub-pixels in the second row are cyclically arranged according to an order of 'green sub-pixel 9 to blue sub-pixel 9 to red sub-pixel 9 to green sub-pixel 9'. It can be seen that, the cyclical orders of the sub-pixels 9 in the two rows are actually the same.

Meanwhile, the adjacent sub-pixels 9 in the column direction are staggered from each other by ½ of the sub-pixel in the row direction, and the sub-pixels 9 of the same color are not located in the same column.

That is, the adjacent rows in the display panel of the embodiment are not 'aligned' in the column direction, but are ½ of the sub-pixel 9 'staggered' from each other. Therefore, in the column direction, except the few sub-pixels 9 on the edges, each sub-pixel 9 is adjacent to two sub-pixels 9 in the adjacent row, and moreover, the sub-pixel 9 has a color different from those of the two sub-pixels 9, since the sub-pixels 9 of the same color are not located in the same column. In this way, any three adjacent sub-pixels 9 of different colors will constitute a '品' arrangement which enables the sub-pixels 9 of three colors to be distributed more uniformly and the display quality to be better.

Preferably, the display panel of the embodiment is an organic light-emitting diode (OLED) panel, that is to say, each sub-pixel 9 thereof includes a light-emitting unit (organic light-emitting diode), and the light-emitting unit of each sub-pixel 9 directly emits light of required color and luminance. Or, the display panel can also be a liquid crystal display panel, that is to say, each sub-pixel 9 thereof includes a filter unit, and the light becomes the light of required color and luminance after transmitting the filter unit of each sub-pixel 9.

In summary, the display panel may be of various types, so long as distribution of the sub-pixels 9 thereof accords with the conditions above, which will not be described in detail herein.

Specifically, the display method of the embodiment includes the following steps.

S101. An original image composed of a matrix of virtual pixels 2 is generated according to image information.

That is, the image information (i.e. content of image to be displayed) from a graphics card and the like is processed to generate an original image composed of a matrix of a plurality of 'points (i.e. virtual pixels 2)'; each virtual pixel 2 includes original components of red, green and blue colors, in order to represent the respective 'densities' of red, green and blue colors on the 'point'.

In this case, the term "component" in the above 'original component', subsequent 'display component' or the like refers to 'density' of the color which should be displayed in the corresponding location and can be represented by 'luminance', and the embodiment takes it as an example. Certainly, so long as each 'component' can represent the 'density' to be displayed, other metric parameters can also be adopted. For example, 'gray scale', 'saturation' or the like can be used as unit of the 'component'.

S102. Each virtual pixel 2 is arranged to correspond to a sampling location 8, wherein among the sampling locations in each row, the sampling locations 8 corresponding to the virtual pixels 2 are distributed in a plurality of distribution sections, wherein one sampling location 8 is included between any two adjacent sampling locations 8 corresponding to the virtual pixels 2 in each distribution section, three sampling locations 8 are included between two adjacent distribution sections; among the sampling locations 8 in the any two adjacent rows, the sampling locations 8 corresponding to the virtual pixels 2 are not arranged in the same columns, wherein each sampling location 8 corresponds to a location between two adjacent sub-pixels 9 in one row and a central location of a sub-pixel 9 in the other row.

That is, as illustrated in FIG. 2, a plurality of 'sampling locations 8' will be formed on the display panel in accordance with the above arrangement mode. Specifically, each sampling location 8 is located between the two adjacent rows of the sub-pixels 9, and any sampling location 8 is located between two adjacent sub-pixels 9 in one row and also located in the central location of a sub-pixel 9 in the other row. Or rather, a central location of every three sub-pixels 9 which constitute a '品' arrangement is a sampling location 8. It can be seen that, the sampling locations 8 also constitute a 'matrix' of which row number is 1 less than that of the sub-pixels 9 and column number is 2 less than twice of the number (because the sub-pixels 9 in different rows are not aligned to each other in the column direction, it does not have column number) of the sub-pixels 9 in one row. It should be understood that each sampling location 8 is not an entity which really exists but is only used for representing a corresponding location, and all the sampling locations 8 constitute a matrix for locating the locations of the virtual pixels.

The step is as illustrated in FIG. 3, each virtual pixel 2 in the virtual image is caused to correspond to each sampling location 8 mentioned above, in order to determine display components of the sub-pixels 9 in the subsequent process.

For clarity, in FIG. 3, no sampling location 8 is marked anymore, while only virtual pixels 2 are marked, in which each virtual pixel 2 is represented by a triangle, and the number mn in the triangle represents the virtual pixel 2 in the $m^{th}$ row and the $n^{th}$ column. Therefore, the sampling locations 8 with the triangles represent the presence of the corresponding virtual pixels 2, and the rest sampling locations 8 without the triangle represent the absence of the virtual pixel 2. Specifically, the correspondence relationship between the virtual pixels 2 and the sampling locations 8 is as follows.

As illustrated in FIG. 3, each row of virtual pixels 2 correspond to a row of sampling locations 8 in turn; and in any two adjacent rows of sampling locations 8, the sampling locations 8 corresponding to the virtual pixels 2 are located in odd and even locations respectively. Therefore the sampling locations 8 corresponding to the virtual pixels 2 in adjacent rows are not aligned in the column direction, and the vertexes of the triangles representing the virtual pixels 2 point to the same directions.

Moreover, the virtual pixels 2 correspond to the "distribution sections" in the rows of sampling locations 8, three sampling locations 8 are included between two adjacent distribution sections, and one sampling location 8 is included between any two adjacent sampling locations 8 corresponding to the virtual pixels 2 in each distribution section. Except the distribution sections at the ends of a row, each of the other distribution sections corresponds to two virtual pixels 2; as such, most of the distribution sections include three sampling locations 8 (two sampling locations 8 corresponding to two virtual pixels 2, and one sampling location 8 therebetween which does not correspond to a virtual pixel 2). Except the distribution sections at the ends of a row, the other distribution sections are "staggered" in adjacent rows; that is, among the sampling locations 8 in any two adjacent rows, the sampling locations 8 corresponding to the virtual pixels 2 are not arranged in the same columns. As shown in FIG. 3, disregarding the edge regions, every two sampling locations 8 corresponding to the virtual pixels 2 form a "pair", and every "pair" of sampling locations 8 corresponding to the virtual pixels 2 in a row corresponds to the space between the "pairs" of sampling locations 8 corresponding to the virtual pixels 2 in the adjacent row.

It can be seen that, as for the virtual image with resolution of 1920 columns×1080 rows, about (5760 columns×1080 rows) sampling locations 8 are required (disregarding the edge regions). Accordingly, 1081 rows of sub-pixels 9 each having 2881 sub-pixels 9 are required (2881×2−2=5760). As for the virtual image with resolution of 1920 columns×1080 rows, in the existing display method, (3×1920×1080) sub-pixels 9 are required to perform the display; while according to the display method of the embodiment, the number of the required sub-pixels 9 is 2881×1081, which is approximately equal to half of the number of the sub-pixels 9 required in the existing display panel. Therefore, the display method of the embodiment can increase the display resolution by about 2 times while maintaining the physical resolution.

Preferably, in any two adjacent rows of sampling locations 8, in one row, each distribution section has two sampling locations 8 corresponding to the virtual pixels 2; and in the other row, two distribution sections at two ends of the row have respectively one and three sampling locations 8 corresponding to the virtual pixels 2, while each of the other distribution sections has two sampling locations 8 corresponding to the virtual pixels 2.

Obviously, if each distribution section in all the rows has two sampling locations 8 corresponding to the virtual pixels 2, in some rows, three sampling locations 8 (the sampling locations corresponding to the first distribution section in the adjacent row) at one end will correspond to no virtual pixels 2, such that the display of the image edge may be distorted. For this reason, preferably the manner shown in FIG. 3 is adopted, wherein each distribution section of the sampling locations 8 in the odd rows (or even rows) has two sampling locations 8 corresponding to the virtual pixels 2, while in the even rows (or odd rows, as set above), the distribution sections of the sampling locations 8 in the central location also have two sampling locations 8 corresponding to the virtual pixels 2, but in the two distribution sections at both ends of the row, one distribution section has three sampling locations 8 corresponding to the virtual pixels 2 (of course this distribution section partly coincide with the distribution section of sampling locations 8 in the odd row, for example the distribution section of the sampling locations 8 corresponding to the virtual pixel 21, 22 and 23 in the $2^{nd}$ row in FIG. 3 partly coincide with the distribution section of the sampling locations 8 corresponding to the virtual pixel 11 and 12 in the $1^{st}$ row), and the other distribution section has only one sampling location 8 corresponding to the virtual pixel 2 (such as the distribution section of the sampling locations 8 corresponding to the virtual pixel 210 in the $2^{nd}$ row in FIG. 3), such that the display distortion of the image edge can be reduced.

It can be seen that, when each virtual pixel 2 corresponds to the sampling location 8 in accordance with the above correspondence, each virtual pixel 2 necessarily corresponds to three sub-pixels 9 (i.e. the sub-pixels 9 to which three vertexes of the triangle representing the virtual pixel 2 in FIG. 3 point) around the corresponding sampling location 8. Correspondingly, each sub-pixel 9 necessarily corresponds to one or more virtual pixels 2 (i.e. the vertexes of one or more triangles representing the virtual pixels 2 point to the sub-pixel 9).

Specifically, in the embodiment, except several sub-pixels 9 in the edge region, each standard sub-pixel 9 corresponds to two virtual pixels 2, one of the virtual pixels 2 (i.e. the virtual pixel 2 directly under a sub-pixel 9 in FIG. 3) corresponds to the central location of the sub-pixel 9, and the other virtual pixel 2 (i.e. the virtual pixel 2 located at the up-right or up-left corner of the sub-pixel 9 in FIG. 3) corresponds to the edge region of the sub-pixel 9.

Preferably, the dimension of the sub-pixel 9 in the first or the last row of the display panel in the column direction is ½ of that of the standard sub-pixel 9 in the column direction, and the so-called "standard sub-pixel" refers to the sub-pixel which is not located on the edge of the display panel. Or rather, the standard sub-pixel is a sub-pixel except the sub-pixels in the first and the last rows and at two ends of the respective rows in the display panel.

It can be seen that, in the first or the last row, most of the sub-pixels 9 correspond to one virtual pixel 2 (of course there are few sub-pixels corresponding to two virtual pixels 2 or corresponding to no virtual pixel). Therefore, in order to guarantee a balanced final display effect, the area of the sub-pixel 9 in the first or the last row should be half of that of the rest sub-pixel 9, and thus the height (i.e. the dimension in the column direction) of the sub-pixel 9 in the two rows could be set as half of that of the standard sub-pixel 9.

Preferably, except the first row and last row of sub-pixels 9, two sub-pixels 9 at the ends of the other rows of sub-pixels 9 have one sub-pixel 9 corresponding to one virtual pixel 2, and the dimension of the sub-pixel 9 in the row direction is ½ of that of a standard sub-pixel in the row direction.

Obviously, in most rows of sub-pixels 9, if a sub-pixel 9 at one end corresponds to two virtual pixels 2, the sub-pixel 9 at the other end will correspond to only one virtual pixel 2, the area of such sub-pixel 9 shall be a half of the area of a standard sub-pixel 9, i.e. the "width (the dimension in the row direction)" is preferably a half of the width of a standard sub-pixel 9.

S103. The display component of each sub-pixel 9 is calculated in accordance with the original components of the corresponding colors of the virtual pixels 2 corresponding to the sub-pixel 9.

As previously mentioned, each sub-pixel 9 necessarily corresponds to one or more virtual pixels 2, whereby the content (display component) which should be displayed by each sub-pixel 9 can also be obtained by calculating the original components of the corresponding colors of the virtual pixels 2 corresponding to the sub-pixel, and the specific calculation method may be as follows.

The display component of one sub-pixel 9 is obtained by multiplying the original components of the corresponding colors of the virtual pixels 2 corresponding to the sub-pixels 9 by respective proportional coefficients and then summarizing the respective products.

That is, the display component of any one of the sub-pixels 9 is determined by the original components of the corresponding colors of the virtual pixels 2 corresponding to the sub-pixel in accordance with respective proportions.

In this case, the 'proportional coefficient' is preset, which is normally a nonnegative number, preferably a number between 0 and 1. Each virtual pixel 2 corresponding to each sub-pixel 9 has a proportional coefficient (which of course is a proportional coefficient for the corresponding color component thereof), and these proportional coefficients can be the same or different. The proportional coefficients for the virtual pixels corresponding to the different sub-pixels 9 also can be the same or different. One virtual pixel 2 corresponds to three sub-pixels 9 of different colors, so the proportional coefficients (or rather the proportional coefficients for the original components of different colors) corresponding to the three sub-pixels 9 also can be the same or different.

Preferably, the sum of the proportional coefficients for the original components of the corresponding colors of the virtual pixels 2 corresponding to one sub-pixel 9 is 1.

It can be seen that, the total luminance of the display panel is relevant to the proportional coefficients mentioned above, because each sub-pixel 9 is required to represent the contents of a plurality of the virtual pixels 2 at this time. Moreover, if the sum of the proportional coefficients for the original components of the corresponding colors of the virtual pixels 2 corresponding to one sub-pixel 9 is 1, the constant overall luminance of the display panel and the reality of the display effect can be guaranteed.

Preferably, for a sub-pixel 9 (standard sub-pixel) corresponding to two virtual pixels 2 in which one virtual pixel 2 corresponds to the central location of the sub-pixel 9, the proportional coefficient for the original component of the corresponding color of the virtual pixel 2 ranges from 0.5 to 0.9.

As mentioned above, each standard sub-pixel 9 corresponds to two virtual pixels 2, one virtual pixel 2 is located directly under the sub-pixel 9 while the other virtual pixel 2 is located at upper side location of the sub-pixel 9, then the proportional coefficient for the virtual pixel 2 directly under the sub-pixel 9 preferably ranges from 0.5 to 0.9 (the proportional coefficient for the other virtual pixel 2 preferably ranges from 0.1 to 0.4). The proportional coefficients are different because the relative position relationship among the two virtual pixels 2 and the sub-pixel 9 are different.

For example, specifically, a display component $R_{S2G3}$ of a red sub-pixel 9 with a coordinate of S2G3 may be equal to:

$$R_{S2G3}=X\times R_{12}+Y\times R_{22};$$

wherein $R_{12}$ and $R_{22}$ are red original components of the virtual pixels 2 with coordinates of (1,2) and (2,2) respectively, and X and Y are corresponding proportional coefficients. At this time, the sum of X and Y is preferably 1, Y preferably ranges from 0.5 to 0.9, wherein the coordinate of the virtual pixel in the present embodiment is represented in a Row-Column mode. For example, a coordinate (2, 1) represents the first virtual pixel 2 in the second row, i.e. the virtual pixel 2 marked by 21.

Of course, for the sub-pixels 9 in the edge region except the standard sub-pixels 9, the proportional coefficient for the corresponding virtual pixel 2 may adopt other values as needed.

It can be seen that, the calculations mentioned above only require multiplication and addition operations by using the proportional coefficients and the original components, so the process is simple and the required calculating amount is small.

It should be understood that it is also feasible to calculate the display components of the sub-pixels 9 by using other algorithms in accordance with the original components of the corresponding colors of the corresponding virtual pixels 2.

S104. Preferably, when the original components, the display components and the like mentioned above are luminance, the gray scale of each sub-pixel 9 may be calculated in accordance with the display component of the sub-pixel 9.

Specifically, for the display panel of 256 gray scales, the gray scale can be calculated by luminance through the following formula:

$$A=(G/255)^{\gamma}\times A_{255}$$

wherein A is luminance (i.e. display component) of a certain sub-pixel 9 obtained by calculation; $A_{255}$ is luminance of the sub-pixel having a gray scale value of 255; G, which is an integer between 0 and 255, is a gray scale value corresponding to the luminance A; and γ is a gamma value set at this time.

At this time, all of A, $A_{255}$ and γ are known, so the gray scale G can be correspondingly calculated for subsequent steps.

It should be understood that the formula is also changed accordingly, if other modes such as 64 gray scales are adopted at this time. Or rather, the calculation method herein is different, if the original component and the display component adopt other units of measurement.

S105. The sub-pixels 9 are driven by the calculated gray scale values to display.

That is, each sub-pixel 9 displays the corresponding gray scale, thus obtaining a corresponding picture. FIG. 4 illustrates contrast of resultant images displayed by the existing method and the display method of the embodiment respectively for the same original image. It can be seen that, the image displayed by the display method of the embodiment has higher resolution, more exquisite structure, smoother color transition and better display effect.

In the display method of the present invention, the content displayed by each sub-pixel (i.e. standard sub-pixel) is substantially determined by two virtual pixels adjacent to this sub-pixel. That is, each sub-pixel is 'shared' by two virtual pixels. Or rather, each sub-pixel is used for representing the contents of the two virtual pixels at the same time, thereby enabling the visual resolution to be twice of the actual resolution in combination with a specific display panel, and a better display effect can be obtained. At the same time, the content displayed by each sub-pixel is directly obtained by calculation according to a plurality of specific virtual pixels without complex calculations such as 'partitioning, layering and area ratio'. Therefore, the display method is simple in process and small in calculating amount.

It may be understood that, the foregoing embodiments are merely exemplary embodiments employed for illustration of the principle of the present invention, and the present invention is not limited thereto. For a person of ordinary skill in the art, various variations and improvements may be made without departing from the spirit and essence of the present invention, and those variations and improvements shall be regarded as falling into the protection scope of the present invention.

The invention claimed is:

1. A display method applied to a display panel, wherein the display panel comprises a plurality of rows of sub-pixels, sub-pixels in each row being formed by cyclically arranging sub-pixels of three colors, and cyclical orders of the sub-pixels in respective rows being equal; adjacent sub-pixels in a column direction having different colors and being staggered from each other by ½ of the sub-pixel in a row direction, wherein the display method comprises following steps:

S1, generating an original image composed of a matrix of virtual pixels;

S2, enabling the virtual pixels to correspond to sampling locations, wherein among the sampling locations in each row, the sampling locations corresponding to the virtual pixels are distributed in a plurality of distribution sections, wherein one sampling location is included between any two adjacent sampling locations corresponding to the virtual pixels in each distribution section, three sampling locations are included between two adjacent distribution sections; among the sampling locations in any two adjacent rows, the sampling locations corresponding to the virtual pixels are not arranged in a same column, wherein each sampling location corresponds to a location between two adjacent sub-pixels in one row and a central location of a sub-pixel in another row; and S3, calculating a display component of each sub-pixel in accordance with original components of corresponding colors of the virtual pixels corresponding to the sub-pixel, wherein, in any two adjacent rows of sampling locations, in one row, each distribution section has two sampling locations corresponding to the virtual pixels; and in the other row, two distribution sections at two ends of the other row have one and three sampling locations corresponding to the virtual pixels, respectively, while each of other distribution sections has two sampling locations corresponding to the virtual pixels.

2. The display method according to claim 1, wherein the display panel is a liquid crystal display panel or an organic light-emitting diode display panel.

3. The display method according to claim 2, wherein a dimension of a sub-pixel in a first or last row in the column direction is ½ of that of a standard sub-pixel in the column direction.

4. The display method according to claim 2, wherein step S3 comprises:

obtaining the display component of each sub-pixel by multiplying the original components of the corresponding colors of the virtual pixels corresponding to the sub-pixel by respective proportional coefficients and then summarizing respective products.

5. The display method according to claim 1, wherein the sub-pixels of three colors include a red sub-pixel, a blue sub-pixel and a green sub-pixel.

6. The display method according to claim 5, wherein a dimension of a sub-pixel in a first or last row in the column direction is ½ of that of a standard sub-pixel in the column direction.

7. The display method according to claim 1, wherein a dimension of a sub-pixel in a first or last row in the column direction is ½ of that of a standard sub-pixel in the column direction.

8. The display method according to claim 1, wherein except a first row and a last row of sub-pixels, one sub-pixel of two sub-pixels at the ends of the other rows of sub-pixels corresponds to one virtual pixel, and a dimension of the one sub-pixel in the row direction is ½ of that of a standard sub-pixel in the row direction.

9. The display method according to claim 1, wherein step S3 comprises:

obtaining the display component of each sub-pixel by multiplying the original components of the corresponding colors of the virtual pixels corresponding to the sub-pixel by respective proportional coefficients and then summarizing respective products.

10. The display method according to claim 9, wherein a sum of the proportional coefficients for the original components of the corresponding colors of the respective virtual pixels corresponding to each sub-pixel is 1.

11. The display method according to claim 9, wherein the proportional coefficient for the original component of the corresponding color of the virtual pixel corresponding to the central location of any standard sub-pixel ranges from 0.5 to 0.9.

12. The display method according to claim 1, wherein both the original component and the display component are luminance and the method further comprises a step S4 after step S3:

S4, calculating a gray scale of each sub-pixel in accordance with the display component of the sub-pixel.

* * * * *